US006397878B1

(12) United States Patent
Nolan

(10) Patent No.: US 6,397,878 B1
(45) Date of Patent: Jun. 4, 2002

(54) HIGH PRESSURE HOSE DROP BACKFLOW/ BACK SIPHONAGE PREVENTERS

(75) Inventor: Kenneth P. Nolan, Rutherfordton, NC (US)

(73) Assignee: Watts Regulator Co., North Andover, MA (US)

( * ) Notice: Subject to any disclaimer, the term of this patent is extended or adjusted under 35 U.S.C. 154(b) by 0 days.

(21) Appl. No.: 09/633,540

(22) Filed: Aug. 7, 2000

Related U.S. Application Data

(60) Provisional application No. 60/147,368, filed on Aug. 5, 1999.

(51) Int. Cl.[7] ..... E03C 1/10
(52) U.S. Cl. ..... 137/218; 137/512.4
(58) Field of Search ..... 137/218, 512.4

(56) References Cited

U.S. PATENT DOCUMENTS

| | | | | |
|---|---|---|---|---|
| 3,023,767 A | * | 3/1962 | Woodford | 137/218 |
| 3,587,622 A | | 6/1971 | Hardison | |
| 3,636,968 A | * | 1/1972 | Tine | 137/218 X |
| 3,747,621 A | * | 7/1973 | Tine | 137/218 |
| 3,818,929 A | * | 6/1974 | Braukmann | 137/218 |
| 3,862,640 A | | 1/1975 | Hechler, IV | |
| 3,905,382 A | * | 9/1975 | Waterston | 137/218 X |
| 3,906,987 A | * | 9/1975 | Rushforth et al. | 137/218 |
| 4,013,089 A | * | 3/1977 | Braukmann | 137/218 |
| 4,284,097 A | | 8/1981 | Becker et al. | |
| 4,658,852 A | * | 4/1987 | Weingarten | 137/218 |
| 4,821,763 A | * | 4/1989 | Ackroyd et al. | 137/218 |
| 4,893,654 A | | 1/1990 | Feuz | |
| 5,031,661 A | | 7/1991 | Feuz | |
| 5,117,860 A | | 6/1992 | Horner, Jr. | |
| 5,878,773 A | | 3/1999 | Robol | |

OTHER PUBLICATIONS

Product Description: Series 9D Backflow Preventer with Intermediate Atmospheric Vent, Watts Products Division, (1997).

* cited by examiner

*Primary Examiner*—Gerald A. Michalsky
(74) *Attorney, Agent, or Firm*—Fish & Richardson, PC

(57) ABSTRACT

A backflow and back-siphonage preventer assembly, consisting of a ball valve and a double check valve backflow preventer with an atmospheric vent, provides isolation protection on high pressure plumbing supply lines, such as high pressure hose drops used for the washdown of equipment and facilities, e.g. in food processing plants. The backflow preventer includes a housing with an inlet, an outlet, and a drain outlet therebetween. A first valve is upstream of the drain outlet passage, and a second valve is downstream of the drain outlet, a sealing member moves between a first position in which the drain outlet passage is closed, and a second position in which the drain outlet passage is open. A reinforcing member operatively coupled to the sealing member permits operating pressures of greater than about 500 psi without blow-out of the sealing member.

28 Claims, 5 Drawing Sheets

HIGH PRESSURE HOSE DROP BACKFLOW/ BACK SIPHONAGE PREVENTERS

This application claims the benefit of U.S. Provisional Application No. 60/147,368, filed Aug. 5, 1999.

This invention relates to backflow and back-siphonage preventers, in particular for use on high pressure plumbing supply lines.

BACKGROUND OF THE INVENTION

High pressure hose drops, e.g. operating at pressures of up to 400 psi, are often used for the washdown of equipment and facilities, such as in food processing plants. It is recognized that it is desirable to protect a plumbing supply line providing water to hose drop stations against contamination by reverse flow through the hose (i.e. backflow and/or back-siphonage) of potentially contaminated water from the processing and rendering areas into the potable water supply.

SUMMARY OF THE INVENTION

According to the invention, a high pressure hose drop is equipped with a backflow and back-siphonage preventer assembly consisting of a ball valve and a double check valve backflow preventer with an atmospheric vent. The backflow and back-siphonage preventer assembly of the invention is particularly suited for isolation protection on high pressure plumbing supply lines, such as high pressure hose drops used for the washdown of equipment and facilities, e.g. in food processing plants.

According to one aspect of the invention, a backflow preventer includes a housing defining a fluid flow channel, an inlet at an upstream region of the housing in fluid communication with the fluid flow channel, an outlet at a downstream region of the housing in fluid communication with the fluid flow channel, and a drain outlet passage between the upstream region and the downstream region. A first valve is located upstream of the drain outlet passage for controlling fluid flow in the fluid flow channel, and a second valve is located downstream of the drain outlet passage for controlling fluid flow in the fluid flow channel. The backflow preventer includes a sealing member configured to move between a first position in which the drain outlet passage is closed to limit fluid communication between the drain outlet passage and the fluid flow channel, and a second position in which the drain outlet passage is open to permit fluid communication between the drain outlet passage and the fluid flow channel. A reinforcing member is operatively coupled to the sealing member to permits operating pressures of greater than about 500 psi without blow-out of the sealing member.

Embodiments of this aspect of the invention may include one or more of the following features. The sealing member is biased toward the first position in the absence of backflow in the fluid flow channel. The first valve includes a valve member. The valve member is moved out of engagement with the sealing member during normal flow. The valve member is biased toward a position in engagement with the sealing member by, for example, a spring.

In the illustrated embodiment, the valve member is biased toward a closed position against a seat. The reinforcing member is biased toward the first position. The sealing member provides the seat and a biasing force for biasing the reinforcing member toward the first position.

The reinforcing member is configured to move between a first position in which the drain outlet passage is closed to limit fluid communication between the drain outlet passage and the fluid flow channel, and a second position in which the drain outlet passage is open to permit fluid communication between the drain outlet passage and the fluid flow channel. The sealing member and the reinforcing member are coupled such that movement of the sealing member during backflow conditions allows the reinforcing member to move toward its second position. The reinforcing member is biased toward its second position by, for example, a spring. The reinforcing member is positioned between the sealing member and the outlet passage.

A ball valve and a strainer are located upstream of the first valve.

According to another aspect of the invention, a valve assembly includes a housing defining a fluid flow channel, an inlet at an upstream region of the housing in fluid communication with the fluid flow channel, an outlet at a downstream region of the housing in fluid communication with the fluid flow channel, and a drain outlet passage between the upstream region and the downstream region. A valve is located upstream of the drain outlet passage for controlling fluid flow in the fluid flow channel. The valve assembly includes a sealing member configured to move between a first position in which the drain outlet passage is closed to limit fluid communication between the drain outlet passage and the fluid flow channel, and a second position in which the drain outlet passage is open to permit fluid communication between the drain outlet passage and the fluid flow channel. A reinforcing member is operatively coupled to the sealing member to permit operating pressures of greater than about 500 psi without blow-out of the sealing member.

The backflow and back-siphonage preventer assembly of the invention advantageously provides protection against back-siphonage and back-pressure backflow to resist reverse flow of potentially contaminated water from the processing and rendering areas into the potable water supply. The backflow preventer safeguards the water supply, thus ensuring that the water is safe to drink and safe for use in processing meat within the facility.

The assembly is also advantageously designed for non-health hazard applications, and for use where continuous pressure conditions exist. For this purpose, the assembly advantageously incorporates a bronze ball valve shutoff on the inlet of the assembly and incorporates, on the outlet of the assembly, a dual check with atmospheric vent specifically designed to handle temperature and pressure conditions commonly found in the meat processing industry.

Other features and advantages will be apparent from the following description of a presently preferred embodiment.

DESCRIPTION OF THE PREFERRED EMBODIMENTS

Figure 1:
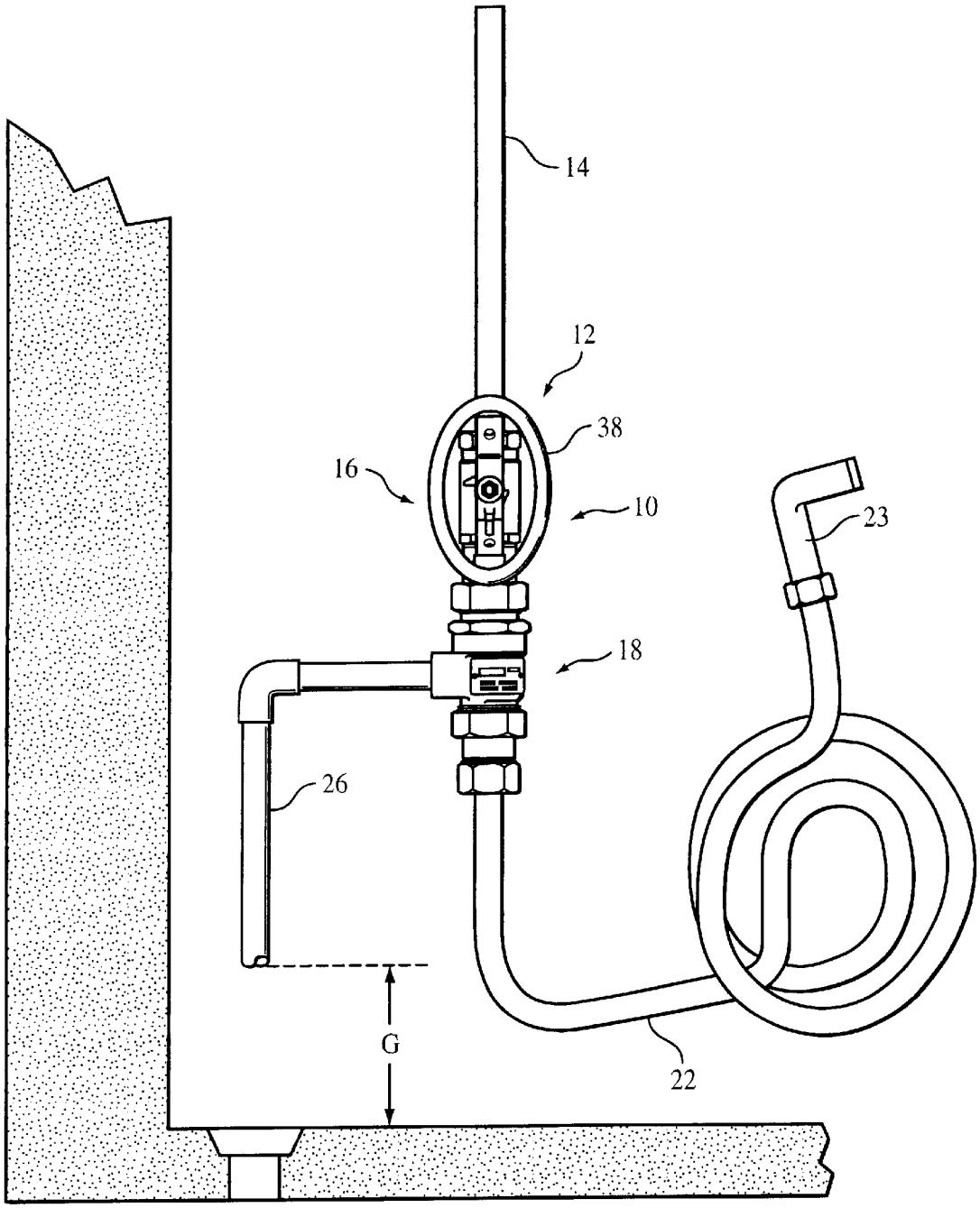
FIG. 1 is a somewhat diagrammatic perspective view of a high pressure hose drop backflow and back-siphonage preventer assembly of the invention mounted for use, e.g., for washdown of equipment and facilities.
Figure 2:
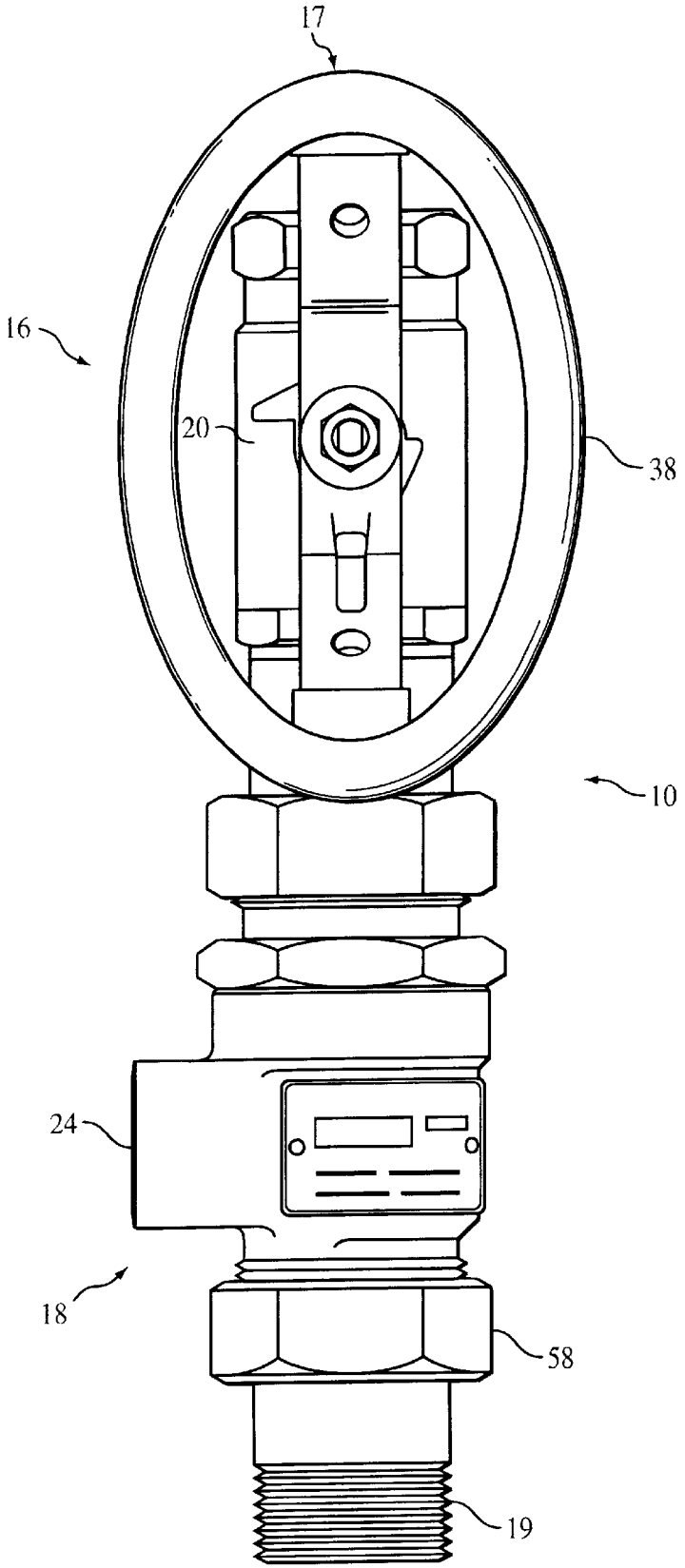
FIG. 2 is a plan view of a high pressure hose drop backflow and back-siphonage preventer assembly of the invention.

Referring to FIGS. 1 and 2, a backflow and back-siphonage preventer assembly 10 of the invention is installed at a hose drop 12 of a high pressure plumbing supply line 14. The backflow and back-siphonage preventer assembly 10 includes a ball valve 16 and a dual check backflow preventer 18. The assembly 10 preferably features all bronze ball valve and backflow preventer body construction, with stainless steel internal parts and durable, tight seating check valve assemblies.

Figure 3:
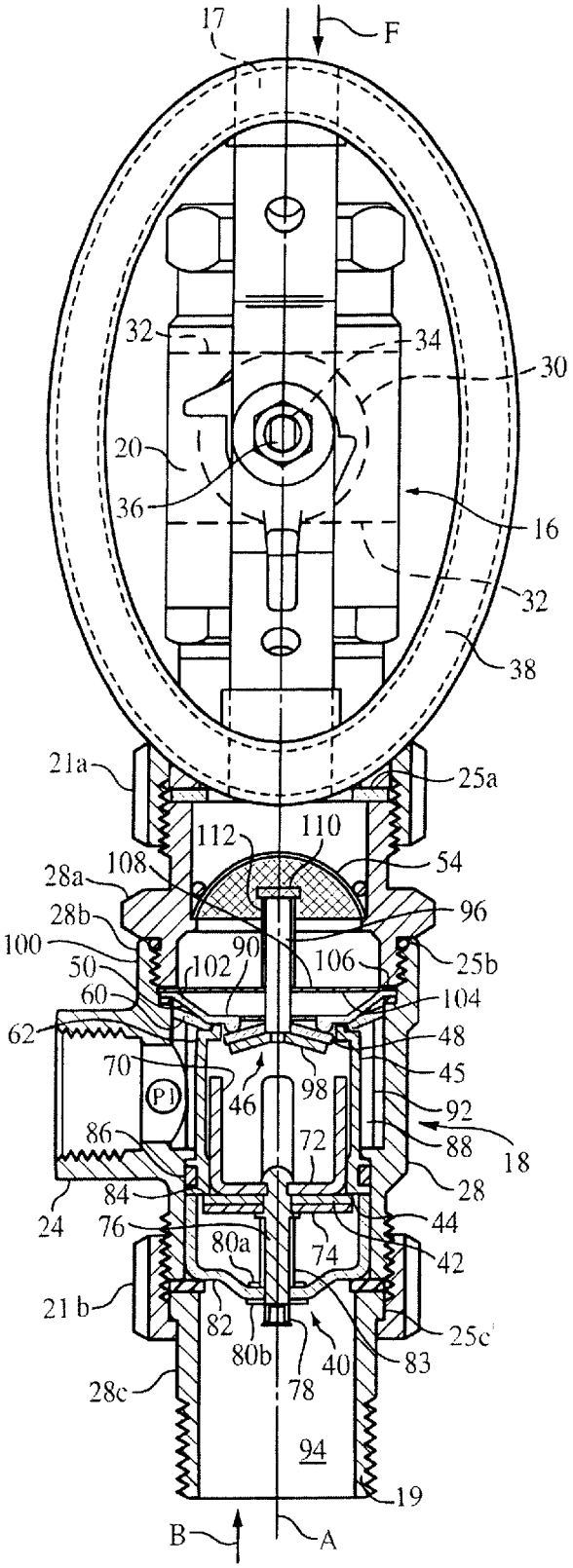
FIG. 3 is a plan view, partially in section, of the high pressure hose drop backflow and back-siphonage preventer assembly of FIG. 2 shown in a rest or normal backflow prevention position.

Referring also to FIG. 3, ball valve 16 has a body 20 defining an assembly inlet 17 which is connected, i.e. threaded, to plumbing supply line 14. The backflow preventer 18 has a body 28 defining an assembly outlet 19 at which there is connected, i.e. threaded, a hose 22 (FIG. 1) terminating in a spray nozzle 23. Body 28 also defines a vent outlet 24 at which there is connected, i.e. threaded, a drain line 26 (FIG. 1). Preferably, the assembly inlet 17 is a female national pipe thread inlet connection and the assembly outlet 19 is a male national pipe thread outlet connection, e.g. ¾ inch or 1 inch; and the vent or drain outlet 24 is a ½ inch threaded connection.

Body 28 includes three sections 28*a*, 28*b*, and 28*c*. Body section 28*a* is connected to ball valve 16 by a union nut 21*a*, body sections 28*a* and 28*b* are threadedly connected at 23, and body section 28*c* is connected to tail piece section 28*b* by a union nut 21*b*. Located between ball valve 16 and body section 28*a* is a gasket seal 25*a* of suitable material, located between sections 28*a* and 28*b* is an o-ring seal 25*b*, and located between sections 28*b* and 28*c* is a gasket seal 25*c* of suitable material. Body section 28*b* defines vent outlet 24, and body section 28*c* defines assembly outlet 19. Sections 28*a* and 28*b* are of bronze construction with a brass male tail piece section 28*c*.

The ball valve 16 is a two piece construction with an ASTM B-584 bronze body 20, an ASTM B-16 or B-124 ENP (electroless nickel plated) brass ball 30, DURAFILL™ or UNISEAL™ reinforced/enhanced PTFE (poly tetra fluoro ethylene) seats 32, Teflon® (PTFE) stem packing 34 (Teflon® is a registered trademark of E.I. DuPont de Nemours & Company, Inc.), a blow-out proof stem 36, and a low profile oval handle 38 for opening and closing ball valve 16.

The dual check valve 18 with atmospheric vent 24 includes a primary check valve 40 utilizing a rubber disc 42 seating against a seat part 44 of a brass insert 45 to ensure tight sealing. Valve 18 also includes a secondary check valve 46 utilizing a Teflon® (PTFE) disc 48 engaging upon a diaphragm 50 to provide protection against backflow if primary valve 40 fails. Diaphragm 50 is relatively stiff, having a durometer of 40 (Shore D scale), and is supported by a Belleville spring disc 60 to resist blow-out of diaphragm 50 under relatively high working pressures, e.g. up to about 400 psi (27.5 bars). To safely allow for such working pressures, disc 60 reinforces diaphragm 50 such that blow-out of diaphragm 50 at pressures greater than about 500 psi, and preferably up to 600 psi, is prevented.

Disc 42 of primary valve 40 is mounted to a four-pronged guide 70 between a base 72 and a disc 74 of the guide. Fixed to guide 70, and extending from guide base 72, is a rod 76 having a flared end 78. Slidably mounted to rod 76 between two washers 80*a*, 80*b* is a three-pronged guide 82. Guides 70 and 82 are biased to the spaced position shown in FIG. 3 by spring 83. Insert 45 defines a channel 84 for receiving an o-ring seal 86. The outer diameter of insert 45 is less than the inner diameter of body section 28*b* such that a fluid passage 88 is defined therebetween. Disc 60 is pushed up against a lip 62 defined by insert 45 by diaphragm 50. A light spring 90 biases disc 60 away from lip 62. Diaphragm 50 seals against a seat 92 defined by insert 45. Diaphragm 50 and disc 60 together act to control fluid communication between the main fluid path 94 through valve 18 and passage 88.

Disc 48 of secondary valve 46 is mounted to a rod 96 having an enlarged end disc 98. Rod 96 is free to slide along the axis, A, of valve 18 under pressure from forward or back flow acting upon discs 48 and 98. Trapped between body sections 28*a* and 28*b* are an edge 100 of diaphragm 50, and edge 102 of a spring support 104, and a seal washer 106. Support 104 defines through holes 108 for fluid flow. Positioned between support 104 and an enlarged end 110 of rod 96 is a spring 112 which biases disc 48 against diaphragm 50.

An integral stainless steel strainer 54 upstream protects the primary and secondary check assemblies 40, 46 from fouling due to dirt and debris in water from the plumbing supply line. (Prior to installation, the pipe lines should be flushed to remove foreign material, and the strainer should be cleaned every six months, or otherwise as conditions require.)

The backflow and back-siphonage preventer assembly 10 of the invention is designed for use in non-health hazard continuous pressure applications, e.g., a Series 912 HP High Pressure Hose Drop Backflow Preventer, commercially available from Watts Regulator Company of North Andover, Mass., and embodying the invention, is rated at a maximum working pressure of 400 psi (27.5 bars) and a maximum temperature of 160° F. (71° C). The assembly should be installed at all hose drops to provide protection against back-pressure and back-siphonage backflow. It can be installed vertically for flow-down (as shown in FIG. 1), or it can be installed vertically, for flow-up, or installed horizontally.

Figure 4:
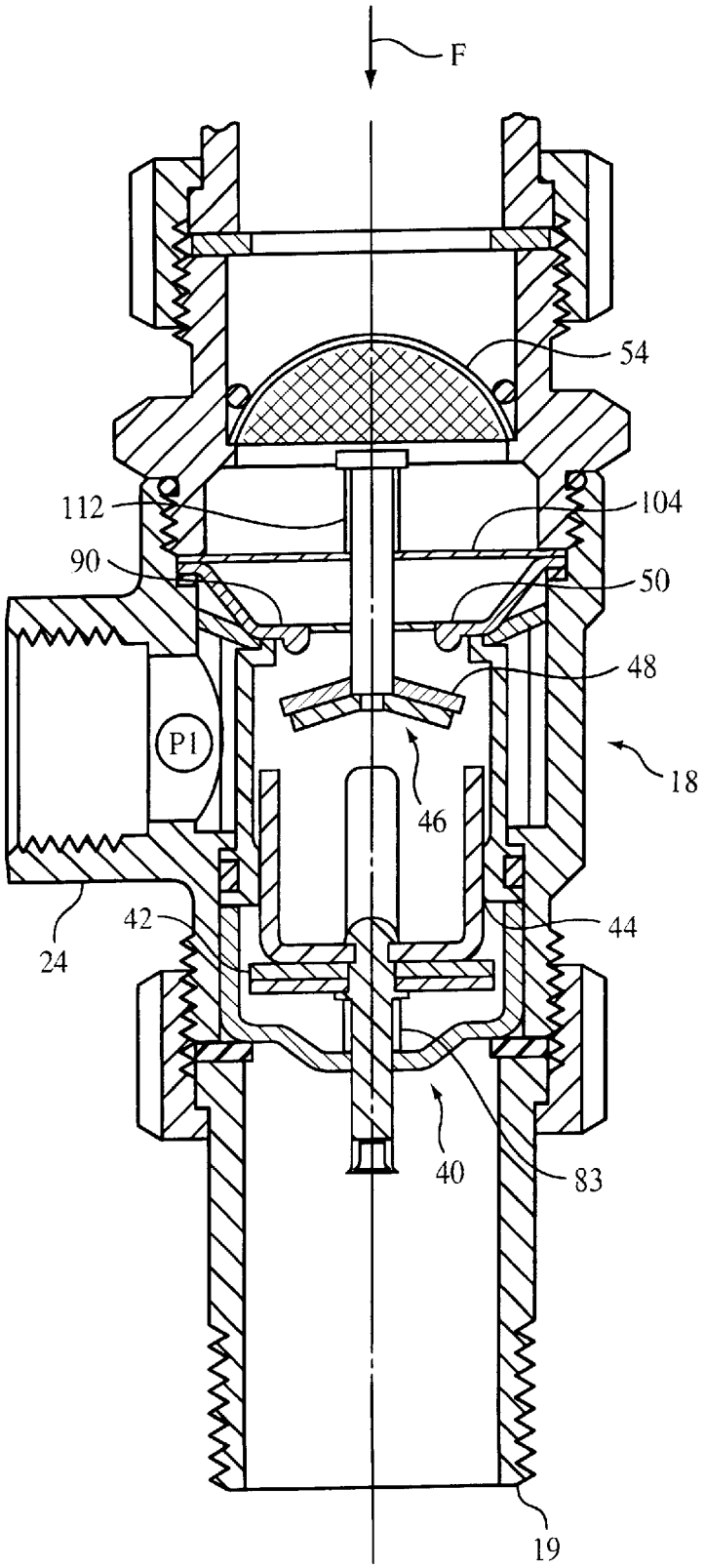
FIG. 4 is a plan view, partially in section, of the high pressure hose drop backflow and back-siphonage preventer assembly of FIG. 2 shown in position for normal flow.

Referring to FIG. 4, in a normal flow situation, indicated by arrow, F, with the ball valve 16 open, water flowing through strainer 54 displaces disc 48 of secondary check valve 46 from its sealing engagement with diaphragm 50, against the bias from spring 83, to permit flow through the secondary check valve 46 toward primary check valve 40. The flowing water also displaces rubber disc 42 from sealing engagement upon seat 44, against the bias from spring 112, to permit flow through the primary check 40 toward the assembly outlet 19, and then to hose 22 and spray nozzle 23. Under normal flow conditions, the vent or drain outlet 24 is closed by pressure of diaphragm 50 against drain seat 90. Disc 60 supports diaphragm 50 during normal flow to resist blow-out of diaphragm 50 under relatively high working pressures.

In normal backflow or back-siphonage conditions, with water flowing back toward the outlet 19 (arrow, B, of FIG. 3) from hose 22, the rubber disc 42 is urged into sealing engagement upon seat 44, as shown in FIG. 3, thereby to resist backflow of potentially contaminated water through the primary check valve 40 of the backflow preventer 18, toward the plumbing supply line 14 (FIG. 1).

Figure 5:
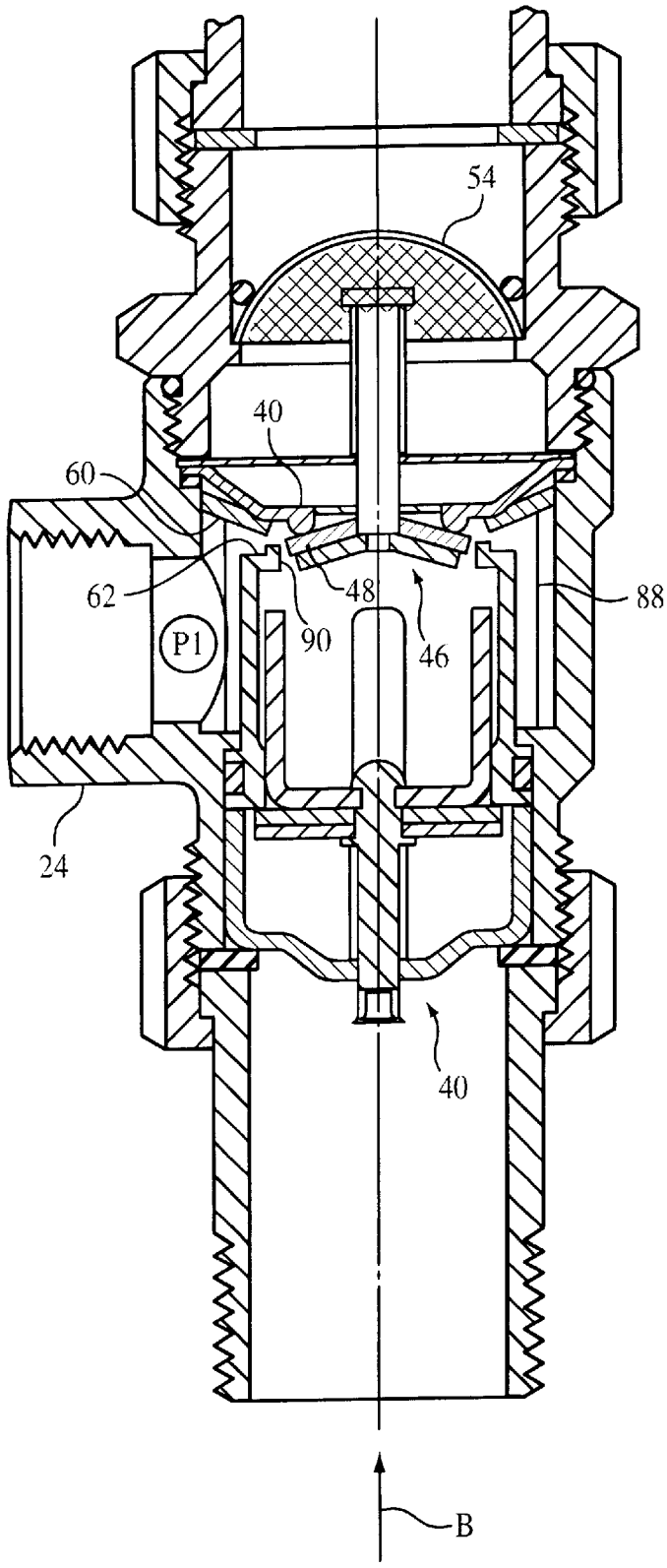
FIG. 5 is a plan view, partially in section, of the high pressure hose drop backflow and back-siphonage preventer assembly of FIG. 2 shown in position for preventing backflow when the primary check valve has failed.

Referring to FIG. 5, in the event of fouling of the downstream (primary) check valve 40, leakage past the primary check valve is vented to atmosphere by way of the vent or drain outlet 24, thereby providing a visual indication of failure of the check assembly. In particular, pressure of water backflow (arrow, B) bears upon the secondary check valve 46, urging the disc 48 into sealing engagement upon the diaphragm 50, thus to resist backflow of potentially contaminated water through the secondary check valve 46 of the backflow preventer 18, into the plumbing supply line 14. At the same time, the backflow pressure acts to deflect the diaphragm 50 (in the direction of arrow, B), thereby moving diaphragm 50 out of engagement with seat 90. The force of spring 88 acts to slide disc 60 out of engagement with lip 62. The movement of diaphragm 50 and disc 60 opens a path for fluid communication to passage 88 and outlet 24 to allow the potentially contaminated water to exit from the backflow preventer 18 by way of the drain line 26 (FIG. 1).

Some discharge from the vent outlet 24 is also to be expected, especially during start-up, until all seating surfaces seal. However, continuous discharge is an indication that the check valve components may require cleaning or replacement. Quick closing valves, water hammer, and/or supply pressure fluctuations can also cause intermittent discharge. The installation of a water hammer arrestor (e.g. a Series 05 water hammer arrestor available from Watts Regulator Company) or a water pressure reducing valve (e.g. an N35B water pressure reducing valve, also available from Watts Regulator Company) may be installed to correct the problem.

Referring again to FIG. 1, the discharge or drain line 26 should be piped in accordance with local code requirements. It is important also that the backflow and back-siphonage preventer assembly 10 be installed where discharge from the vent outlet 24 will not cause damage. A physical air gap, G, should be maintained between the end of the discharge pipe 26 and the associated floor drain 64, e g. by cutting the pipe on a 45° bevel, at a distance of 12 inches above the floor drain or through an air gap piped to a floor drain.

Other embodiments are within the scope of the following claims.

What is claimed is:

1. A backflow preventer, comprising:

a housing defining a fluid flow channel, an inlet at an upstream region of the housing in fluid communication with the fluid flow channel, an outlet at a downstream region of the housing in fluid communication with the fluid flow channel, and a drain outlet passage between the upstream region and the downstream region, a first valve located upstream of the drain outlet passage for controlling fluid flow in the fluid flow channel, a second valve located downstream of the drain outlet passage for controlling fluid flow in the fluid flow channel, a sealing member configured to move between a first position in which the drain outlet passage is closed to limit fluid communication between the drain outlet passage and the fluid flow channel, and a second position in which the drain outlet passage is open to permit fluid communication between the drain outlet passage and the fluid flow channel, a portion of the sealing member being positioned across the drain outlet passage, and a reinforcing member configured to support substantially the entire surface of the portion of the sealing member positioned across the drain outlet passage for operating at high pressures without blow-out.

2. The backflow preventer of claim 1 wherein the sealing member is biased toward the first position in the absence of backflow in the fluid flow channel.

3. The backflow preventer of claim 1 wherein the first valve includes a valve member, the valve member moving out of engagement with the sealing member during normal flow.

4. The backflow preventer of claim 3 wherein the valve member is biased toward a position in engagement with the sealing member.

5. The backflow preventer of claim 4 further comprising a spring biasing the valve member toward the position.

6. The backflow preventer of claim 3 wherein the valve member is biased toward a closed position against a seat, the reinforcing member being biased toward the first position, and the sealing member providing the seat and providing a biasing force for biasing the reinforcing member toward the first position.

7. The backflow preventer of claim 1 wherein the reinforcing member is configured to move between a first position in which the drain outlet passage is closed to limit fluid communication between the drain outlet passage and the fluid flow channel, and a second position in which the drain outlet passage is open to permit fluid communication between the drain outlet passage and the fluid flow channel.

8. The backflow preventer of claim 7 wherein the seating member and the reinforcing member are coupled such that movement of the sealing member during backflow conditions allows the reinforcing member to move toward its second position.

9. The backflow preventer of claim 7 wherein the reinforcing member is biased toward its second position.

10. The backflow preventer of claim 9 further comprising a spring biasing the reinforcing member toward its second position.

11. The backflow preventer of claim 1 wherein the reinforcing member is positioned between the sealing member and the outlet passage.

12. The backflow preventer of claim 1 further comprising a ball valve located upstream of the first valve.

13. The backflow preventer of claim 1 further comprising a strainer located upstream of the first valve.

14. The backflow preventer of claim 1 wherein the first valve and the second valve comprise check valves.

15. The backflow preventer of claim 1 wherein the reinforcing member permits operating pressures of greater than about 500 psi without blow-out of the sealing member.

16. A valve assembly, comprising:

a housing defining a fluid flow channel, an inlet at an upstream region of the housing in fluid communication with the fluid flow channel, an outlet at a downstream region of the housing in fluid communication with the fluid flow channel, and a drain outlet passage between the upstream region and the downstream region, a valve located upstream of the drain outlet passage for controlling fluid flow in the fluid flow channel, the valve including a valve member, the valve member moving out of engagement with the sealing member during normal flow, a sealing member configured to move between a first position in which the drain outlet passage is closed to limit fluid communication between the drain outlet passage and the fluid flow channel, and a second position in which the drain outlet passage is open to permit fluid communication between the drain outlet passage and the fluid flow channel, a portion of the sealing member being positioned across the drain outlet passage, and a reinforcing member configured to support substantially the entire surface of the portion of the sealing member positioned across the drain outlet passage for operating at high pressures without blow-out.

17. The backflow preventer of claim 16 wherein the sealing member is biased toward the first position in the absence of backflow in the fluid flow channel.

18. The backflow preventer of claim 16 wherein the valve member is biased toward a position in engagement with the sealing member.

19. The backflow preventer of claim 18 further comprising a spring biasing the valve member toward the position.

20. The backflow preventer of claim 16 wherein the valve member is biased toward a closed position against a seat, the reinforcing member being biased toward the first position, and the sealing member providing the seat and providing a biasing force for biasing the reinforcing member toward the first position.

21. The backflow preventer of claim 16 wherein the reinforcing member is configured to move between a first position in which the drain outlet passage is closed to limit fluid communication between the drain outlet passage and the fluid flow channel, and a second position in which the drain outlet passage is open to permit fluid communication between the drain outlet passage and the fluid flow channel.

22. The backflow preventer of claim 21 wherein the sealing member and the reinforcing member are coupled such that movement of the sealing member during backflow conditions allows the reinforcing member to move toward its second position.

23. The backflow preventer of claim 21 wherein the reinforcing member is biased toward its second position.

24. The backflow preventer of claim 23 further comprising a spring biasing the reinforcing member toward its second position.

25. The backflow preventer of claim 16 wherein the reinforcing member is positioned between the sealing member and the outlet passage.

26. The backflow preventer of claim 16 wherein the valve comprises a check valve.

27. A valve assembly, comprising:

a housing defining a fluid flow channel, an inlet at an upstream region of the housing in fluid communication with the fluid flow channel, an outlet at a downstream region of the housing in fluid communication with the fluid flow channel, and a drain outlet passage between the upstream region and the downstream region, a valve located upstream of the drain outlet passage for controlling fluid flow in the fluid flow channel, a sealing member configured to move between a first position in which the drain outlet passage is closed to limit fluid communication between the drain outlet passage and the fluid flow channel, and a second position in which the drain outlet passage is open to permit fluid communication between the drain outlet passage and the fluid flow channel, a portion of the sealing member being positioned across the drain outlet passage, a reinforcing member configured to support substantially the entire surface of the portion of the sealing member positioned across the drain outlet passage for operating at high pressures to permit operating pressures of greater than about 500 psi without blow-out of the sealing member, and a spring biasing the reinforcing member toward its second position.

28. A valve assembly, comprising:

a housing defining a fluid flow channel, an inlet at an upstream region of the housing in fluid communication with the fluid flow channel, an outlet at a downstream region of the housing in fluid communication with the fluid flow channel, and a drain outlet passage between the upstream region and the downstream region, a valve located upstream of the drain outlet passage for controlling fluid flow in the fluid flow channel, a sealing member configured to move between a first position in which the drain outlet passage is closed to limit fluid communication between the drain outlet passage and the fluid flow channel, and a second position in which the drain outlet passage is open to permit fluid communication between the drain outlet passage and the fluid flow channel, the sealing member being biased toward the first position in the absence of backflow in the fluid flow channel, a portion of the sealing member being positioned across the drain outlet passage, a reinforcing member configured to support substantially the entire surface of the portion of the sealing member positioned across the drain outlet passage for operating at high pressures to permit operating pressures of greater than about 500 psi without blow-out of the sealing member.

* * * * *